US005777584A

United States Patent [19]

Rothe

[11] Patent Number: 5,777,584

[45] Date of Patent: Jul. 7, 1998

[54] PLANAR ANTENNA

[75] Inventor: Lutz Rothe, Halle, Germany

[73] Assignee: Pates Technology GmbH, Lubeck, Germany

[21] Appl. No.: 652,454

[22] PCT Filed: Nov. 29, 1994

[86] PCT No.: PCT/EP94/03957

§ 371 Date: May 31, 1996

§ 102(e) Date: May 31, 1996

[87] PCT Pub. No.: WO95/15591

PCT Pub. Date: Jun. 8, 1995

[30] Foreign Application Priority Data

Dec. 1, 1993 [DE] Germany ..... 43 40 825.7

[51] Int. Cl.[6] ..... H01Q 1/38

[52] U.S. Cl. ..... 343/700 MS; 343/863

[58] Field of Search ..... 343/700 MS, 795, 343/814, 815, 822, 850, 862, 863; H01Q 1/38, 1/50, 21/06

[56] References Cited

U.S. PATENT DOCUMENTS

| | | | |
|---|---|---|---|
| 3,921,177 | 11/1975 | Munson | 343/846 |
| 4,386,357 | 5/1983 | Patton | 343/700 MS |
| 4,686,535 | 8/1987 | Lalezari | 343/700 MS |
| 4,835,540 | 5/1989 | Haruyama | 343/700 MS |
| 4,973,972 | 11/1990 | Huang | 343/700 MS |
| 5,087,920 | 2/1992 | Tsurumaru et al. | 343/700 MS |
| 5,309,164 | 5/1994 | Dienes et al. | 343/700 MS |

FOREIGN PATENT DOCUMENTS

| | | |
|---|---|---|
| 200 819 A2 | 11/1986 | European Pat. Off. . |
| 528 423 A1 | 2/1993 | European Pat. Off. . |
| 41 30 477 A1 | 3/1993 | Germany . |
| 41 38 424 A1 | 5/1993 | Germany . |
| 42 39 597 A1 | 6/1993 | Germany . |
| 42 44 136 A1 | 7/1993 | Germany . |
| 62-048 103 | 3/1987 | Japan . |

OTHER PUBLICATIONS

Dr. Werner Mielke, "Planar kontra Parabol" [Planar vs. Parabolic Satellite TV Antennas], in *Funkshau*, pp. 54–58 (Nov. '88).

Ito, et al., "Planar Antennas For Satellite Reception", in *IEEE Transactions on Broadcasting*, vol. 34, No. 4, pp. 457–464 (Dec. '88).

*Primary Examiner*—Michael C. Wimer
*Attorney, Agent, or Firm*—Milton Oliver

[57] ABSTRACT

The invention relates to a planar antenna 1 having surface resonators 5, which are connected via a supply network 6 to a supply point 7, the supply point 7 of the planar antenna 1 being connected via a coupling element 13 to an electronic circuit 12, particularly a converter, the coupling element 13 being a coaxial conductor in which the ratio, between the outer diameter of the inner conductor and the inner diameter of the outer conductor 17, changes between the supply point 7 of the supply network 6 and the terminal 11 of the electronic circuit 12.

18 Claims, 4 Drawing Sheets

PLANAR ANTENNA

FIELD OF THE INVENTION

The invention relates to a planar antenna.

BACKGROUND

The presently known antenna systems for the reception of satellite signals, especially TV, Astra and DSR signals, within the DBS band (direct broadcasting satellite) of 11.70 GHz to 12.50 GHz for electronic communication means, are based upon the electromagnetic excitation of dipole groups, which are respectively supplied with power in specific phases with respect to each other and thereby generate linearly or circularly polarized radiation fields. Such planar antennas are implemented mostly in triplate technology or microstrip technology. Downstream of the planar antenna, there is connected an electronic device, particularly a converter, which processes the signals, according to the particular application.

Coupling of the planar antenna and the electronic parts is in most cases by means of a hollow waveguide with capacitive coupling-in of the radiation summation signal.

In this type of planar antenna with electronics connected downstream, the required dimensions of the individual subassemblies are disproportionately large, in order to obtain a sufficiently large reception and transmission power, with the result that the antenna becomes unnecessarily heavy in weight and unwieldy, thus making such radio systems unsuitable for hand-held applications. Further, manufacturing requirements, with respect to dimensions of the individual parts for the hollow waveguide used, are very great, and the coupling of signals between the planar antenna, the hollow waveguide and the electronics is problematical, with the result that, in case of even small manufacturing-tolerance deviations, the signals, from one component to the next, become insufficiently coupled. Further, noise matching or compensation using such a hollow waveguide conductor is not possible.

JP-A-62-048103, assigned MATSUSHITA, discloses a securing element for a microstrip-conductor-antenna, by means of which the antenna is connectable to a coaxial conductor. It is based on a microstrip conductor antenna, which comprises a dielectric material, onto whose first surface, the microstrip conductor is secured and onto whose other surface, the grounding conductor is secured. The grounding conductor has, compared to the dielectric material, a significantly greater thickness. The generically defined microstrip conductor antenna of JP-A-62-048103 has a securing element which is fastened onto the grounding conductor by means of screws. In the securing element is a central pin, which is held in position by means of a cylindrical dielectric body. The central pin has a region of smaller diameter and a region of larger diameter, the region of smaller diameter penetrating the dielectric material and the microstrip conductor and being connected to the latter by solder. Such a construction of the central pin has advantages and disadvantages. advantages are that the soldering, first, of the free end of the part with the microstrip conductor and, secondly, through the thicker region of the central pin, makes easier the connection to the external circuit (not shown). As set forth in the JP-A-62-048103 discussion of prior art, the structure of small and large diameters in the central pin leads to problems, since the jump in external diameter of the central pin, adjacent the interface region between grounding conductor and the dielectric body, leads to a mismatch of impedance of the microstrip conductor antenna. A mismatch of impedance has the consequence that reflection- and radiation-losses occur. The avoidance of such reflection- and radiation-losses is the object of JP-A-62-048103. For solution of the above-described problem, JP-A-62-048103 proposes to lengthen the region of the central pin in the direction of the grounding conductor, and, in the region of the grounding conductor, to surround the pin with a bushing consisting of a dielectric material, thereby creating an additional characteristic impedance and permitting a matching of impedance among the regions of differing diameters on the central pin. The JP-A-62-048103 suggests for this purpose suitable diameters D1 and D2. In order to make a connection to the electronics, one must insert, into the fastening element, a coaxial bushing not disclosed in the JP-A-62-048103. From JP-A-62-048103, it is thus known to match impedance in the fastening element. The fastening element of JP-A-62-048103 is, however, in its dimensions, large relative to the dimensions of the planar antenna, which means the connection of planar antenna and downstream electronics would consume a disproportionately large space. Further, the transmission losses of the fastening element are great, whereby the performance of the antenna would be detrimentally influenced, since an impedance matching of the planar antenna and downstream electronics is not possible.

SUMMARY OF THE INVENTION

It is therefore an object of the invention to provide a compact radio system with planar antenna coupling element and downstream electronics which consists of parts which are simple and cost-effective to make, and by means of which an impedance matching among the planar electronics and the downstream electronics is possible.

This object is achieved, in accordance with the invention. The coupling element thus comprises, advantageously, only a few parts, which are easy to manufacture. As a result of the fixed galvanic coupling by means of an electromagnetic element or aperture of this type, the radio system is particularly robust against mechanical forces and also against dirt, and is thus outstandingly adapted for portable applications or uses. By means of the radio system in accordance with the invention, depending on the formation of the surface resonators, linearly and circularly polarized waves can be received or transmitted, whereby advantageous signals from the most varied satellites can be received and transmitted. The surface resonators are either square- or rectangle-shaped. The impedance matching of the components by means of the coupling element can be performed advantageously relatively easily by altering the lengths and/or diameters of segments A1, A2 and A3 of inner- and outer-conductors. Advantageous dimensions can be determined with the aid of suitable numeric approximation methods, the changes in dimension and changes in material of one part having an effect on the dimensions or material constants of the other parts to be selected. One obtains a good impedance and noise matching, using the values specified in subclaim 11 for the coupling element. On the basis of the values described, the radio system is optimized for a frequency range of 11.70–12.50 GHz.

As a result of the stepwise variation in outer diameter of the inner conductor and its two-part structure, the radio system can be assembled easily and quickly. No additional parts are required in order to hold the inner conductor parts and ring disks in place. Furthermore, the numerical process is simplified, as a result of the subdivision of the coupling element into the three segments A1, A2 and A3, since only three characteristic impedances need to be factored into the calculation.

As the outer ends of the inner conductor of the coupling piece are soldered to the feedpoint, or to the connection point, respectively, a durable electrical connection between the individual components is obtained. Impedance matching can also be achieved by selecting the inner diameter of the outer conductor and the outer diameter of the inner conductor to be constant, while, simultaneously, contiguous dielectric ring elements, having differing dielectric constants, are arranged between the baseplates of the planar antenna and the downstream electronics. The thickness of the respective annular element and its material determine the characteristic impedance of the segment. By means of a suitable numeric process, optimum values can be calculated.

Due to the method of construction using microstrip technology, the planar antenna and downstream electronics can be produced relatively economically and simply, which provides a great cost advantage, particularly at high production rates.

The mechanical carrier plate stabilizes the radio system and advantageously seals off the coupling element and also the ground planes from the outside.

To receive or transmit circularly polarized electromagnetic waves by means of the planar antenna, rectangular or square-shaped surface resonators can be used; in the case of the square-shaped resonators, additional parasitic radiating elements, in the form of strip conductors, are arranged parallel to two opposite edges of a surface resonator, at a specific spacing therefrom. The spacing, to be selected for each, varies, depending upon which frequencies, or oscillation conditions, the surface resonator is being optimized for. The surface resonators and the parallel strip conductors can be advantageously produced using a laser beam, a rectangular shape having first been produced by a lithographic process. Using a laser beam, an exact matching of the surface resonators or a selective frequency displacement of surface resonators of a group with respect to each other can then be carried out.

Instead of the parallel strip conductors, which are producible by means of a laser beam or the lithographic process, frequency matching can also be performed by two identical mimic elements, e.g. capacitive reactances, for the square surface resonator, these elements being connected by one pole in the intersection of the surface diagonals and by their other pole to one edge of the surface resonator; the two edges must be opposing each other, in order to obtain symmetry sufficient for oscillation conditions. Using the mimic elements (e.g. capacitors), one can achieve cost-effective adjustment, which can easily be performed manually.

Furthermore, slots can be made in square-shaped surface resonators in the centers of two opposite edges by means of a laser or by the etching method, which make it possible to transmit or receive circularly polarized waves by square-shaped surface resonators too. At a slot width of 0.025 of the line wavelength, mode superposition is achieved, to obtain a circular polarization with ellipticity of less than 1 dB over the frequency range of the planar antenna. The dimensions of the slots must be identical here. The length of the slots, in the direction of the midpoint of the surface resonator, determines the frequency which is received/transmitted by the surface resonator.

Due to an additional thin dielectric film, impedance matching between the surface resonators and the radiation space is also obtained, by means of which the gain of the antenna is increased advantageously. The surface resonators, the supply system and the coupling element are also protected advantageously from external influences, such as dirt and water.

BRIEF FIGURE DESCRIPTION

In the following, exemplary embodiments of the invention are more fully described, with reference to the drawings.

Shown are:

FIG. 1, a top view of a planar antenna with an array composed of surface resonators, which are connected with identical phase, via a supply network, to a feed or supply point.

FIG. 2, a side view of the coupling element.

FIG. 3, a side view of the coupling element.

FIG. 4, a surface resonator element with parallel strip conductors.

FIG. 5, a surface resonator element with mimic elements.

FIG. 6, a surface resonator element with slot-conductor element.

DETAILED DESCRIPTION

FIG. 1 shows a top view of a planar antenna (1). The planar antenna (1) is manufactured using microstrip technology and the baseplate (2) is made of RT/duroid 5880, which is coated on its flat sides with a thin copper film (3, 8), the film thickness being 17.5 micrometers. The planar antenna (1) has several surface resonators (5), which are connected, with identical phase, to a feed point (7) by means of a supply network (6). Surface resonators (5), supply network (6) and the feed point (7) are produced using a current photolithographic process. The side of the planar antenna (1), remote from the radiation space, forms the ground plane (8) of the planar antenna (1). The supply network (6) and the surface resonators are adapted in impedance to each other by thin strip conductors (9) and are connected to the edges of the surface resonators (5) at an angle of 45 degrees to the extended surface resonator edges (10).

Coupling of the feed point (7) of the planar antenna (1) and the connection point (11) of the downstream electronics (12) is performed by a coupling element (13), as shown in FIGS. 2 and 3. The downstream electronic device (12) is likewise produced using the microstrip technique and has its ground plane (14) on the side adjacent the planar antenna (1) and the soldered electronics (15) on the side facing away from the planar antenna, and also a connection point (11).

The coupling element (13) consists of the three segments A1, A2 and A3, having respective lengths LA1, LA2 and LA3 shown in FIG. 3, which form characteristic wave impedances Z1, Z2 and Z3. The outer conductor (17) is a bushing, which comes into electrical contact on its front faces (18) with the ground planes (8,14) by means of a press connection, during assembly of the radio system. A mechanical carrier plate (19) is located between the ground planes (8, 14), and it surrounds the outer conductor (17). The inner conductor comprises two rotationally symmetrical elements (20, 21). The outer diameter (D3) of the inner conductor element (21) shown lowermost is equal to the inner diameter of the bore (22) of the central segment (A2, 23). The other inner conductor element (24), shown uppermost, has a smaller diameter (D1) than the central inner-conductor segment (23). Onto both axially-outer inner-conductor elements (21,24), ring wheels or disks (R1, R2), preferably of quartz or polytetrafluoroethylene (PTFE), are slid; their inner diameters are equal to the appropriate outer diameter (Dl, D3) of the inner-conductor segments (21, 24) and their outer diameters are equal to the inner diameter (DA) of the outer conductor (17). A ring air gap

(28) is provided between the central inner-conductor segment (23) and the outer conductor (17). The sum of the lengths LA1, LA2, LA3 of segments A1, A2 and A3 equals the spacing between the two baseplates (2,29). The two outer inner-conductor segments (21, 24) extend through the baseplates (2, 29) and are soldered respectively to the feedpoint (7) and to the connection point (11).

The bore (22) of the center inner conductor part (23) is deep enough that, taking into account manufacturing tolerances, there is always an air gap (L) between the front face of the outer inner-conductor segment (21) and the bottom of the bore (22).

Above the surface resonators (5), at a spacing of half a free-space wavelength, a thin dielectric film (35) is arranged parallel. Its dielectric constant is so selected that the radiation space and planar antenna (1) are matched to each other in impedance. This is achieved if the thickness of the dielectric film is approximately 0.6 to 0.9 mm and the dielectric constant is equal to 2.05 to 4.

Specific embodiments of surface resonators (5) are shown in FIGS. 4 and 5.

Thus, FIG. 4 shows a square surface resonator (5), which has, at its edges (30) running parallel to the Y axis, at a spacing (A), parallel-arranged strip conductors (31), which represent parasitic radiation elements. The purpose of the strip conductors (31) is mode matching.

Figure 1:
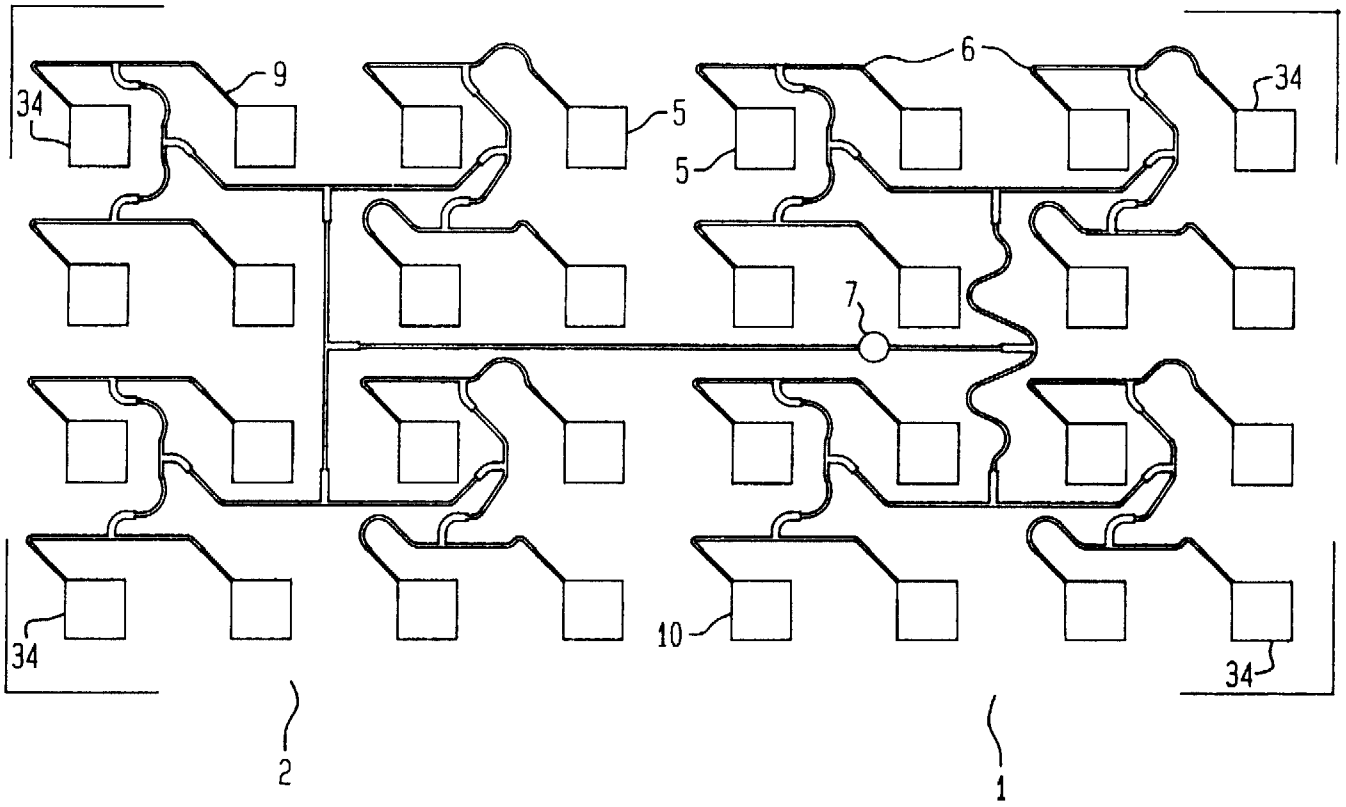
Figure 2:
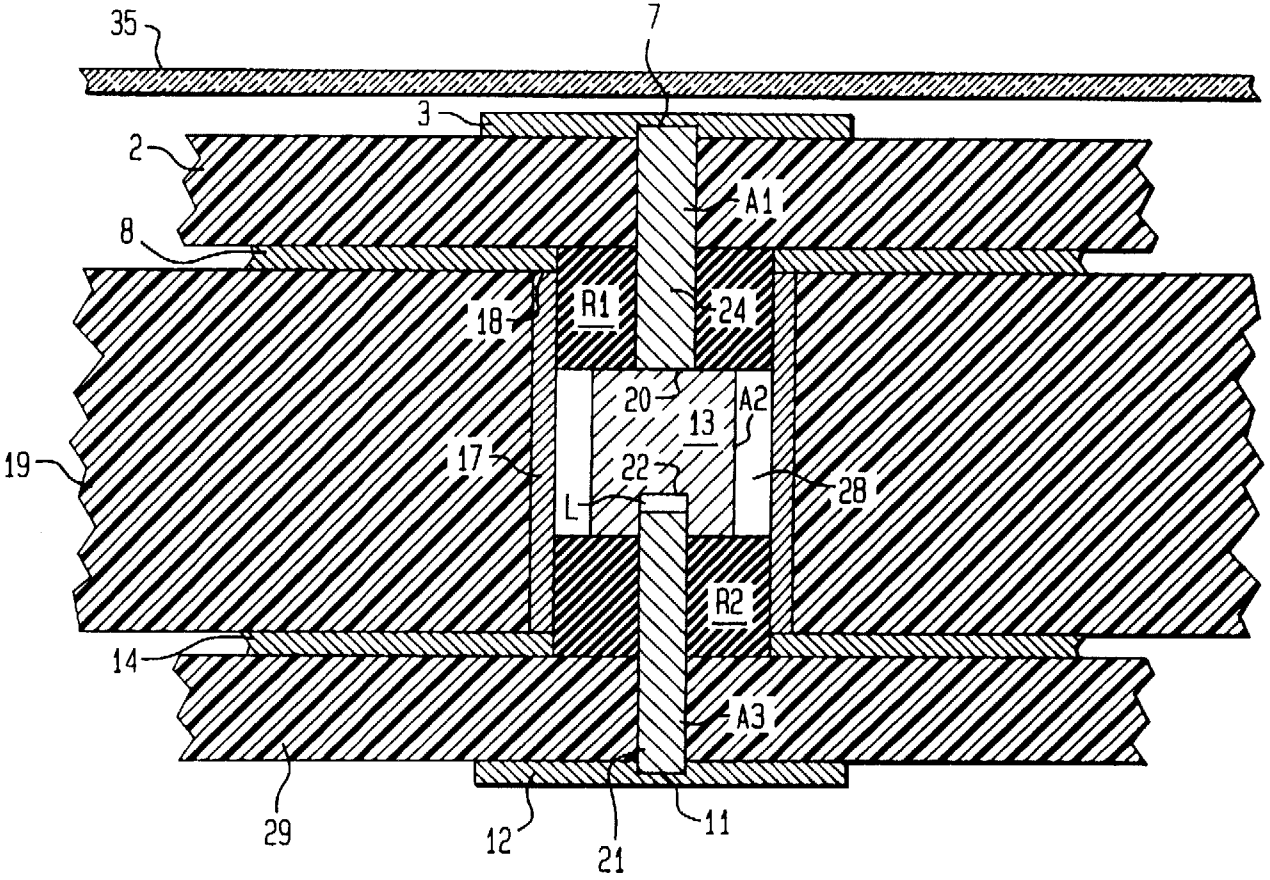
Figure 3:
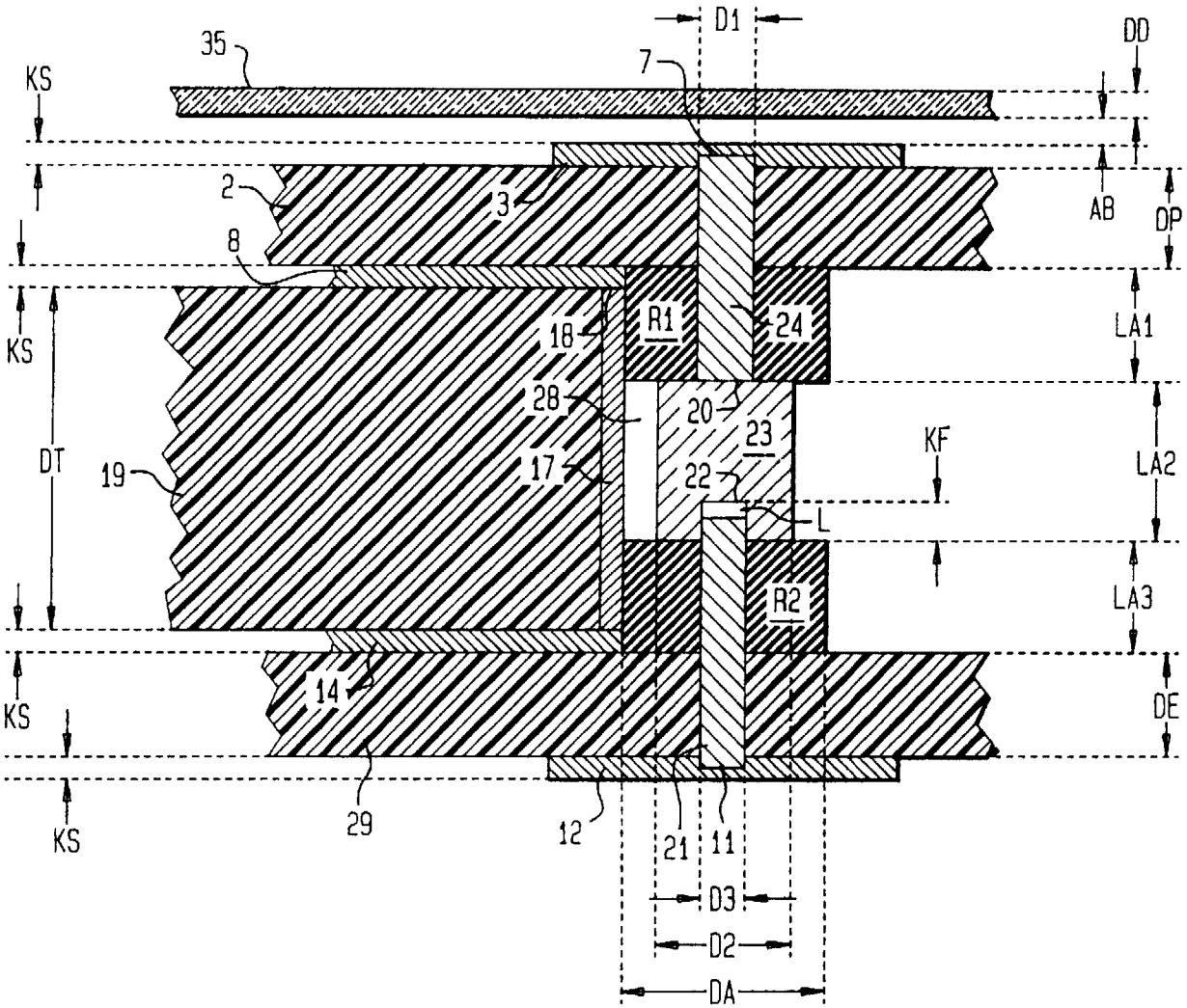
Figure 6:
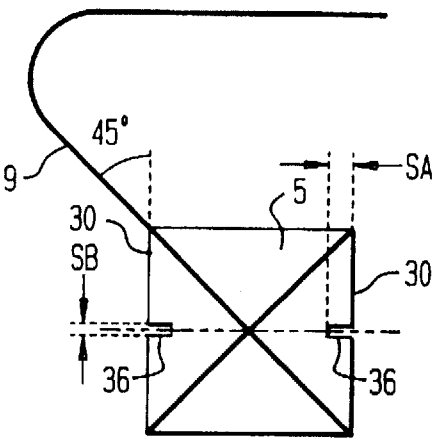
FIG. 6 shows a square surface resonator (5), at the edges (30) of which, two slots (36) are formed, in line with the midpoint (32), and having the length (SA) and the width (SB).
Figure 5:
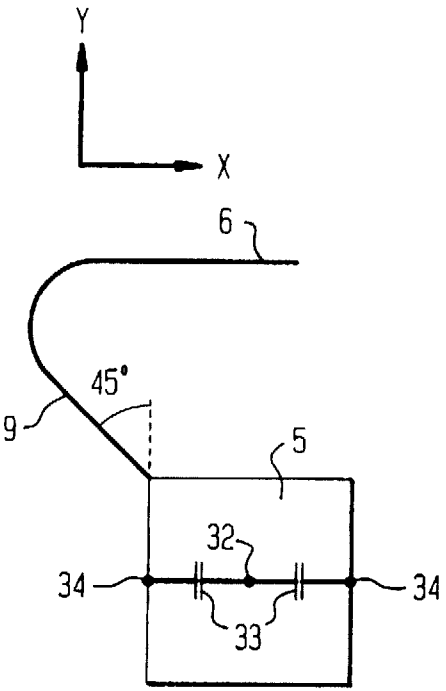
FIG. 5 shows a square surface resonator (5), at the midpoint (32) of which two capacitive mimic elements (33) (capacitors) are connected. The mimic elements (33) are connected to opposite edges (30) of the surface resonator (5) by their other poles (34).
Figure 4:
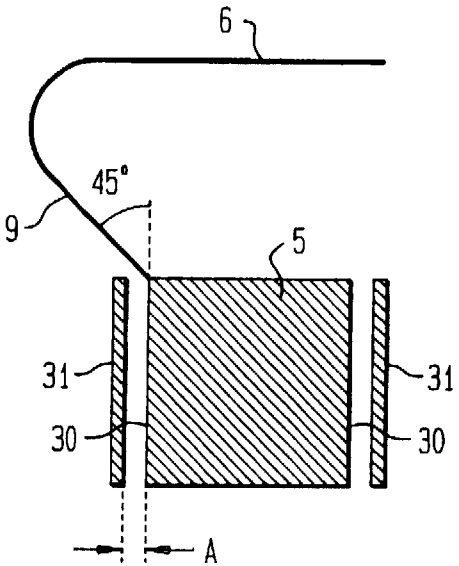

What is claimed is:

1. Planar antenna (1) with surface resonators (5), which are connected to a feedpoint (7) by means of a supply network (6), the feedpoint (7) of the planar antenna (1) being connected to a terminal and connection point (11) of a connected electronic circuit (12) by means of a coupling element (13), wherein the coupling element (13) is a coaxial conductor, in which the ratio, of the outer diameter of the inner conductor to the inner diameter of the outer conductor (17), changes between the feedpoint (7) of the supply network (6) and the terminal (11) of the connected electronic circuit (12), characterized in that the inner conductor of the coaxial conductor has three segments (A1,A2,A3) having different respective diameters (D1,D2,D3), an outer end of a first inner conductor element (24) being in electrical contact with the feedpoint (7) of the planar antenna (1) and an outer end of a second inner conductor element (21) being in electrical contact with the connection point (11) of the connected electronic circuit (12)

the diameter (D2) of a central segment (A2) is larger than diameters (D1, D3) of said first and second inner conductor elements (24, 21)

and the first and second inner conductor elements are surrounded, at least partially, by a respective ring disk (R1,R2) and each segment of said coaxial conductor creates a characteristic wave impedance (Z1,Z2,Z3) whose magnitude is determined by the diameters (D1, D2,D3,DA), by the materials forming the inner- and outer-conductors (20,21,24,17) and by the heights of the ring disk (R1,R2) of the respective segments.

2. Planar antenna in accordance with claim 1, characterized in that one end of the inner conductor is in electrical contact with the feedpoint (7) of the planar antenna (1) and the other end is in contact with the connection point (11) of the connected electronic circuit (12) and the outer conductor (17) is in electrical contact with ground planes (8, 14) of the planar antenna (1) and also with the connected electronic circuit (12).

3. Planar antenna in accordance with claim 1, characterized in that the inner conductor (20) comprises a plurality of axially aligned individual elements (21, 23, 24) in electrical contact with each other, a central one (23) of said elements has a larger diameter than outermost ones (21, 24) of said elements, and an antenna-remote one of said outermost elements (21) is at least partially inserted in a recess formed in an antenna-remote face of said central one (23) of said elements.

4. Planar antenna in accordance with claim 1, characterized in that the planar antenna (1) and the connected electronic circuit (12) are matched to each other with respect to impedance and by means of the characteristic wave impedances (Z1, Z2, Z3) formed by individual segments of the coaxial conductor.

5. Planar antenna in accordance with claim 1, characterized in that the planar antenna (1) and the electronic circuit (12) are manufactured with microstrips each comprising a respective dielectric carrier plate (2, 29), having a coupling-element-remote face which supports strip-shaped metallic conductors, the supply network (6) with feedpoint (7), the surface resonators (5) and electronic circuit (12) and another face which supports a respective metallic ground plane (2, 29) which is in electrical contact with the outer conductor (17) and in that a respective outer segment of the inner conductor which faces the planar antenna (1) and connected electronic circuit (12) extends through, with its outer end, the dielectric carrier plate (2, 29) in the area of the feed point (7) or the connection point (11) and is in electrical contact with the feed point (7) or the connection point (11), respectively.

6. Planar antenna in accordance with claim 1, characterized in that at least one ring wheel (R1, R2) surrounds each element (21, 24) of the inner conductor, each of which, with one of its front faces, is adjacent to the central segment (23) of the inner conductor and with its other front face is adjacent to a carrier plate (2) of the planar antenna (1) or a carrier plate (29) of the electronic circuit (12), respectively.

7. Planar antenna in accordance with claim 1, characterized in that at least one mechanical carrier plate (19) is between metallic ground planes (8, 14) of the planar antenna (1) and the electronic circuit (12), the thickness of which is approximately equal to the length of the outer conductor (17) of the coaxial conductor, and said carrier plate radially surrounds the outer conductor (17).

8. Planar antenna in accordance with claim 1, characterized in that the planar antenna (1) receives electromagnetic waves in the frequency range 11.70 GHz to 12.50 by means of the surface resonators (5) and feeds these to the feed point (7) by means of the supply network (6), the following dimensions and material properties being suitable for the coupling element (13):

a) outer conductor: material: A1, Cu, or Ag,
conductivity: $35.4*10^6$–$63.5*10^6$ S/m;
inner diameter: (DA) 4.2–5.0 mm, b) inner conductor:
first inner conductor element (A1);
length: (LA1) 1.2–2.3 mm;
outer diameter (D1): 0.8–2.0 mm;
material: A1, Cu, or Ag
conductivity: $10.64*10^6$–$63.5*10^6$ S/m,
central segment (A2):
length: (LA2) 9–14.5 mm;
outer diameter: (D2) 1.8–2.4 mm;
material: A1, Cu, or Ag
conductivity: $35.4*10^6$–$63.5*10^6$ S/m;
second inner conductor element (A3);
length: (LA3) 4.6–8.5 mm;
outer diameter: (D3) 1.1–1.4 mm;
material: A1, Cu, or Ag
conductivity: $10.64*10^6$–$63.5*10^6$ S/m;

c) ring disk (R1):
material: selected from PTFE and quartz
dielectric constants: 2.05–3.75;
inner diameter: 0.8–2.2 mm;
outer diameter: 3.5–4.8 mm;

d) ring disk (R2):
material: selected from PTFE and quartz
dielectric constants: 2.05–3.75;
inner diameter: 0.8–2.2 mm;
outer diameter: 3.5–4.8 mm.

9. Planar antenna in accordance with claim 1, characterized in that the surface resonators (5) are rectangular and have an aspect ratio from y to x equal to 0.935 and are supplied, in phase with each other, by means of the supply network (6), at least one line of the supply network (6) being adjacent to at least one edge of each surface resonator (5) at an angle of 45 degrees with respect to extended resonator edge lines (30), in such a way that a circularly polarized electromagnetic wave of the antenna (1) is received or radiated by means of each surface resonator (5).

10. Planar antenna in accordance with claim 1, characterized in that on two opposite sides (30) running parallel to a Y axis of a square surface resonator (5), a respective strip conductor is arranged, parallel to the respective side, and the strip conductors (31) are arranged with respect to the surface resonator (5) at a respective spacings of 0.02 times the resonant wavelength of the signals received.

11. Planar antenna in accordance with claim 1, characterized in that concentric capacitive elements (33) are connected between the intersection of the surface diagonals of each surface resonator (5) and two opposite edges (30) of each surface resonator (5).

12. Planar antenna in accordance with claim 1, characterized in that the surface resonators (5) are square, and, and, at two opposite edges, each parallel to the X axis, and also in the plane of symmetry, a respective one slot-line element is provided.

13. Planar antenna in accordance with claim 1, characterized in that the surface resonators (5) are square, and shorting pins are provided, at a spacing from the edges running parallel to the X axis in the Y plane of symmetry, between each resonator surface and a conductive ground plane (8).

14. Planar antenna in accordance with claim 1, characterized in that the center points of the surface resonators (5) forming edges (34) of the planar antenna (1) are in electrical contact with ground planes (8) by means of a coupling element means.

15. Planar antenna in accordance with claim 1, characterized in that a thin dielectric film (35), with a dielectric constant of 2.05 to 4, is arranged parallel to a plane of the surface resonators (5).

16. Planar antenna in accordance with claim 15, characterized in that the thin dielectric film (35) is arranged at a distance of half a space wavelength from the surface of the surface resonators (5).

17. Planar antenna in accordance with claim 15, characterized in that the thin dielectric film (35) has a thickness of 0.6 mm to 0.9 mm.

18. Planar antenna in accordance with claim 1, characterized in that the coupling element (13) is a coaxial conductor, in which the outer conductor (17) and the first and second inner conductor elements (23,24), between the feedpoint and connection point (7, 11), have a constant diameter, and between the outer and inner conductors are annular elements (R) of a material having a different dielectric constant.

* * * * *